United States Patent [19]

Morris

[11] 4,327,607

[45] May 4, 1982

[54] TOOL FOR REMOVING LIDS FROM TINS

[76] Inventor: Albert E. Morris, 64 Kuroki St., Penshurst, Sydney, New South Wales, Australia, 2222

[21] Appl. No.: 63,322

[22] Filed: Aug. 2, 1979

[51] Int. Cl.[3] ..... B67B 7/00; B25F 1/00

[52] U.S. Cl. ..... 81/3.36; 81/3.46 R; 81/425 R; 145/46; 7/165

[58] Field of Search ..... 81/425 R, 425 A, 426, 81/418, 419, 5.1 R, 3.46 R, 3.46 A, 3.34, 3.36, 415, 346, 381; 7/126, 165, 125, 151; 145/46

[56] References Cited

U.S. PATENT DOCUMENTS

| | | | |
|---|---|---|---|
| 612,833 | 10/1898 | Dexter | 81/425 R |
| 902,570 | 11/1908 | Ellis | 81/381 |
| 942,549 | 12/1909 | Cronk | 81/425 R |
| 1,490,019 | 4/1924 | Neumaier | 81/5.1 R |
| 1,810,315 | 6/1931 | Kaser | 81/3.36 |
| 2,248,166 | 7/1941 | Eilers | 81/3.46 R |
| 2,700,910 | 2/1955 | Van Niel | 81/5.1 R |
| 3,946,453 | 3/1976 | Torres | 81/418 |

FOREIGN PATENT DOCUMENTS 862468 3/1961 United Kingdom .

*Primary Examiner*—Roscoe V. Parker

*Attorney, Agent, or Firm*—Nilsson, Robbins, Dalgarn, Berliner, Carson & Wurst

[57] ABSTRACT

A gripping tool has first and second displaceably connected members having respective associated jaws. The jaw of the first member is dimensioned to engage under the peripheral lip of a tin lid such as is found on a tin of paint and for this purpose the jaw is preferably of thin flat strip-like form. The jaw associated with the second member is dimensioned so as to project beyond the end of the first member's jaw and downwardly so as to engage over the peripheral lip of the tin lid and down over an adjacent upstanding flange of the lid. The arrangement is such that when the handles are moved in a gripping action, the jaws clamp over the tin lid to permit the tin lid to be loosened for removal from the tin.

5 Claims, 8 Drawing Figures

TOOL FOR REMOVING LIDS FROM TINS

FIELD OF THE INVENTION

The present invention relates to a gripping tool particularly suitable for removing a lid from a tin, the lid having an annular peripheral lip projecting from an upstanding flange.

BACKGROUND TO THE INVENTION

Generally the tip of a screwdriver or a similar tool is used for removing the lid from a tin, the tool being inserted under the lip of the lid and a levering action is used against the top edge of the tin. However, when any appreciable resistance to removal of the lid occurs, for example due to solidified paint, then there is a tendency for such levering to cause a deformation of the lid. This not only makes subsequent removal of the lid more difficult, but may also prevent proper closure of the tin when the lid is re-applied.

The problem becomes more acute with tins having lids of the type that have been introduced in recent years, particularly for larger sizes such as the 5 liter. With such tins, the lid when fitted in the factory is in tight sealing relationship with the tin and is resistant to unintentional removal for example under vibration and impact. This type of tin has a rim at the upper end which is turned over and downwardly to provide an inwardly projecting annular shelf below the height at the top of the rim, which then extends to a U shaped groove projecting downwardly relative to the axis of the tin. The lid of the tin similarly has a generally U shaped edge portion for engaging in the U shaped groove, and a laterally extending annular flange which is adapted essentially to seat against the shelf portion to limit the extent to which the lid is pressed onto the tin.

OBJECT OF THE INVENTION

The present invention is directed to providing a gripping tool which can permit easy and safe removal of the lids from tins with little or no distortion or damage being caused to the tin or the lid.

More particularly the present invention is concerned with a gripping tool having first and second members which are relatively displaceably interconnected and have respective jaw elements at one end for gripping the tin lid.

SUMMARY OF THE INVENTION

According to the present invention, a gripping tool has first and second relatively displaceable interconnected members with respective jaw elements for gripping the lid of a tin, the gripping tool being characterised by the jaw element of the first member being shaped for insertion under the lip of the lid and the jaw element of the second member having a first part and a second terminal part, the first part being shaped and dimensioned for extending over the lip of the lid and the second terminal part being shaped and dimensioned to extend down over the flange of the lid when the gripping tool is closed to cause the lid to be gripped to permit its loosening and removal from the tin.

The gripping tool is preferably constructed generally in the manner of a pair of pincers or pliers with the two members pivotally connected, the nose of the first member being of flat strip-like form for insertion under the peripheral lip of the lid, and the nose of the second member being generally L-shaped for engagement over said lip and the adjoining flange.

The L-shaped nose, which extends over the peripheral lip and the adjoining flange of the lid, serves to reinforce these parts of the lid and resist deformation thereof during loosening and removal of the lid.

Even when the invention is embodied in a tool of simple form, for example simply comprising two pivotally connected members, with some forms of tin it may be possible to at least partially loosen the lid of the tin simply by squeezing together the handles of the tool, although more generally, after having gripped the tool it will be necessary to exert a slight levering action with a bottom surface of a first member resting on the rim at the top edge of the tin which acts as a fulcrum.

With some forms of tin lid, in order to minimise deformation of the lid, it will be necessary to partially loosen the lid progressively at several points around its circumference before it is finally lifted off.

In one advantageous embodiment of the tool, the pivoting axis of the two members is off-set from the longitudinal median of the first member and extends through a protrusion provided on the first member on the same side as the face of the end portion intended to contact the lip of a lid to be removed.

The end portions of each member may conveniently have a width of 4 mm to 12 mm, preferably about 8 mm. The end portion of the first member may advantageously taper from a maximum thickness of about 3 mm to a flat edge facilitating insertion under the lip of a lid, and the terminal portion of the second member may likewise be tapered.

In a preferred form of the invention, the end portions of the respective members preferably co-operate so that if fully closed without being engaged over a tin lid, the tip of the end portion of the first member engages under the end portion of the second member. Furthermore, when the end member is generally L-shaped an included angle of about 113° is provided between the respective arms of the L-shape. More generally the angle may preferably be in the range of 110° to 115°.

BRIEF DESCRIPTION OF THE DRAWINGS

Embodiments of the invention will now be given for the purpose of exemplification only with reference to the accompanying drawings, of which.

DETAILED DESCRIPTION OF THE DRAWINGS

Figure 1:
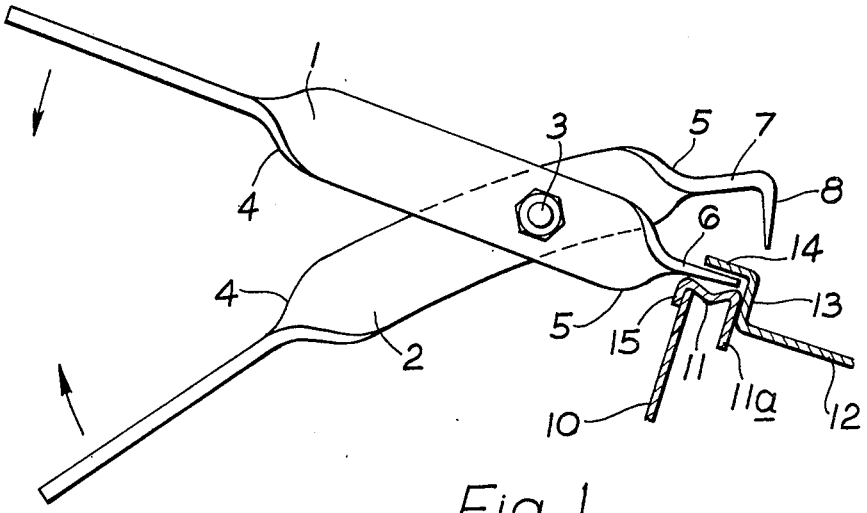
FIG. 1 shows a first embodiment of, gripping tool in side elevation in initial engagement with the lid of a tin shown partially and in cross-section.
Figure 2:
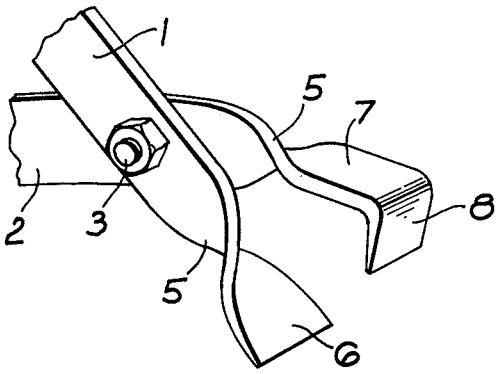
FIG. 2 is a partial perspective view of the tool of FIG. 1 in its open condition.
Figure 3:
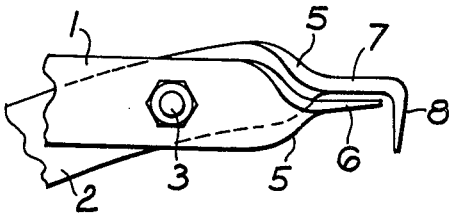
FIG. 3 is a side elevational view of the tool of FIG. 1 in its closed condition.

The gripping tool shown in FIGS. 1–3 is constructed in the manner of a pair of pincers or pliers with first and second members 1 and 2 pivoted together at 3 by a bolt or rivet. Each member is formed from a relatively thick strip of metal with a first twist 4 to provide a handle portion suitable for gripping. The nose of each member is formed with a second twist 5.

The nose 6 of the member 1 is thin, flat and tapered to an edge facilitating insertion under the peripheral lip 14 of a lid 12. The second member 2 has a generally L-shaped nose with a first portion 7 which lies parallel to the nose 6 when the tool is closed and a second, terminal portion 8 extending at about 113° to the portion 7. When the tool is closed as shown in FIG. 3 the tip of the nose 6 is against the top inside portion of the terminal portion 8 of the second member.

An example of one type of tin for which the tool is intended is shown partially in FIG. 1. The tin 10 has an inner annular shelf-like surface and a downwardly extending flange 11*a* extending from a rim 15 of the tin. The lid 12 has a corresponding outer annular lip 14 extending from an upstanding flange 13. When removing the lid 12 from the tin 10 with the illustrated tool, the flat nose 6 is inserted under the peripheral lip 14 of the lip 12. A subsequent squeezing together of the handle portions of the tool will cause engagement of the terminal portion 8 of the L-shaped nose over the flange 13. This action causes the nose 6 to be driven further under the lip 14 and if the handle portions are now moved together downwardly, the nose 6 will pivot about the rim 15 of the tin 10 to lever the lid 12 away from the tin. In general, it is more satisfactory to apply the tool progressively at several locations around the circumference of the tin before the lid is fully released. Usually the flange 13 on the lid will be slightly tapered so that when the lid is fitted to the tin a wedging action occurs between the flange 13 of the lid and the flange 11*a* of the tin.

Figure 4:
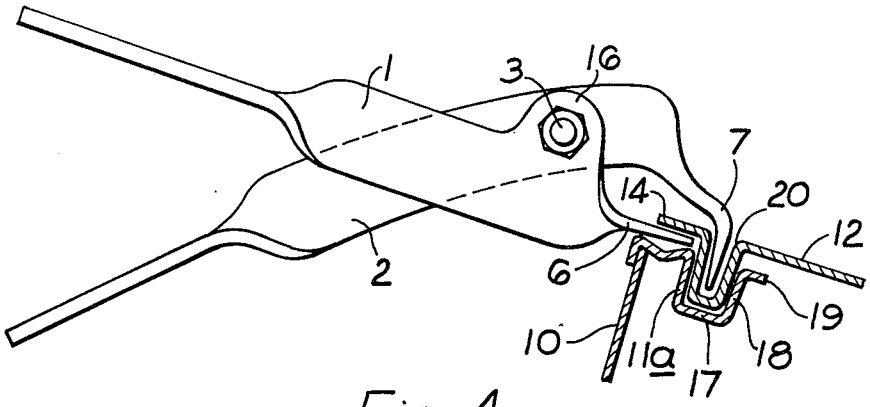
FIG. 4 is a view corresponding to FIG. 1 of a modified form of tool, the tool in this case being shown in an almost closed condition with a modified form of tin shown partially and in cross section.

A second tool is shown in FIG. 4 and is generally similar to the tool in FIG. 1, and only the differences will be highlighted, similar parts being given the same reference numerals. The tool of FIG. 4 has its pivot 3 off-set with respect to the member 1 and passing through a protrusion 16 provided on this member on the same side as the face of the nose 6 intended to contact the lip 14 of a lid. This arrangement has been found to give a more satisfactory levering action in certain applications.

As shown in FIG. 4 a second form of tin 10 is illustrated. In this case a slightly downwardly tapered groove 17 is formed adjacent to the opening to the tin, the outer wall of the annular groove 17 being formed by the flange 11*a* and the opposite wall being formed by wall 18 having an inwardly turned edge 19. The lid 12 has a corresponding shape with a similar U-shaped groove 20 formed between the central portion of the lid and the peripheral lip 14, the dimensions of the groove 20 being chosen in relation to the dimensions of the groove 17 to cause a wedging action, the walls of the respective grooves being slightly resilient. Usually such tins are designed so that a seal is established at several points.

Although the tools illustrated are made from strip metal, metal in rod form may also be used. Furthermore, the shape of the tool may be varied with respect to that illustrated in the drawings to render the tool more suitable for massproduction manufacturing techniques, e.g. stamping, pressing, casting, etc.

Typically, the gripping tool may be formed from mild steel strip of about 12 mm×2.5 mm in cross-section. The two end portions or noses may have a width of about 8 mm and preferably each taper to an edge. The terminal portion of the L-shaped nose may be 6 mm in length, and its distance from the pivot about 33 mm. According to the material used, these dimensions may be varied to achieve the desired strengths and to suit the manufacturing techniques employed.

It has been found that a desirable embodiment of the invention is one which can operate successfully on a wide range of tins having various profiles around the lid and the opening in which the lid fits. In this case, the jaws of the tool are substantially as shown in FIG. 3, with the axis of pivoting being approximately 25 to 30 mm from the end of the nose 6. Furthermore, the axis of pivoting is approximately 6 mm below a plane defining the upper edge of the nose 6 and the lower surface of the first portion 7.

Figure 5:
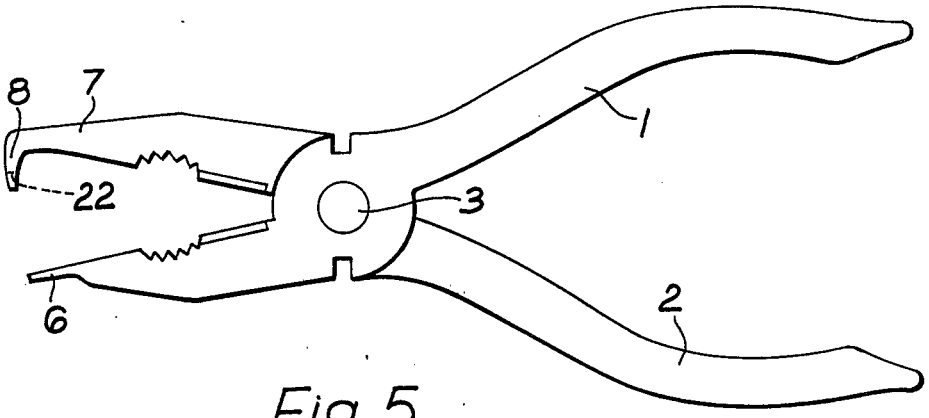
FIG. 5 is a side elevation of a third embodiment.

In the third embodiment of FIG. 5 the tool is a conventional pair of pliers but with a modified end to each of the jaws. The lower jaw has a flattened nose 6 and the upper jaw has an L-shaped end with a terminal portion 8 which co-operates with the flat nose 6 in the same manner as in the above described embodiment of the invention. This tool can be remarkably useful since a multiplicity of tasks can be carried out with the tool. Virtually all tasks normally performed by pliers can still be performed yet tins can also be opened by virtue of the shape of the jaws. A further advantageous feature which is provided is a V-shaped notch 22 provided in the terminal portion 8 of the upper jaw. This permits for example, a screw or bolt to be held with the threaded portion of the screw clamped between the V-shaped groove and the flat nose 6 and indeed the tip of the flat nose 6 could be used to engage in a screwdriver slot in the head of the screw.

Figure 6:
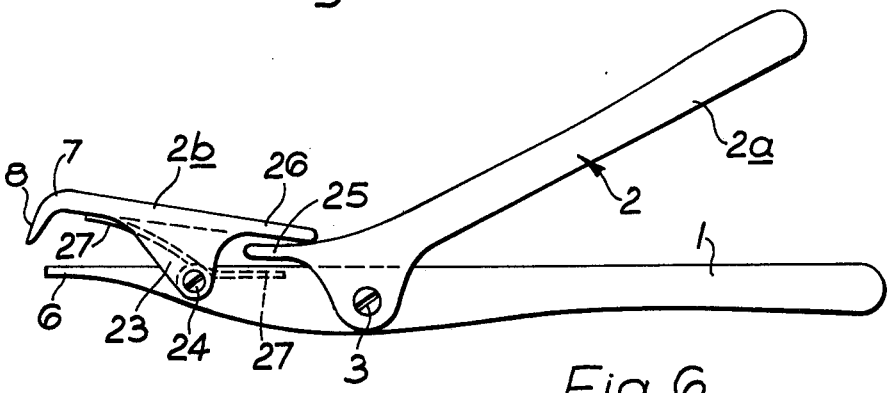
FIG. 6 is a side elevation of a fourth embodiment.

In the embodiment of FIG. 6, the "second member" constitutes a pivotal handle portion 2*a* and a separate pivotally mounted head portion 2*b* having a pair of lateral downwardly extending ears 23 bridging the first member 1 and being pivotally connected thereto by a rivet 24. A lug 25 extends forwardly of the handle 2*a* to engage under a rear tab 26 of the head portion 2*b*, a torsion spring 27 spring biasing the head portion 2*b* in a clock-wise direction as shown in FIG. 6 so that the rear tab 26 presses down on the lug 25 of the handle thereby spring biasing the tool to an open position. The tool functions essentially in the same way as the tools of the previous embodiments.

Figure 7:
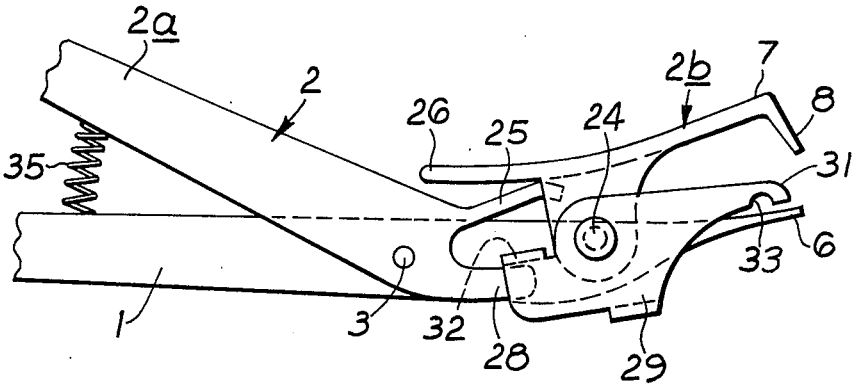
FIG. 7 is a side elevation of a fifth embodiment being a modification of the embodiment of FIG. 6 and having an additional lever arm.
Figure 8:
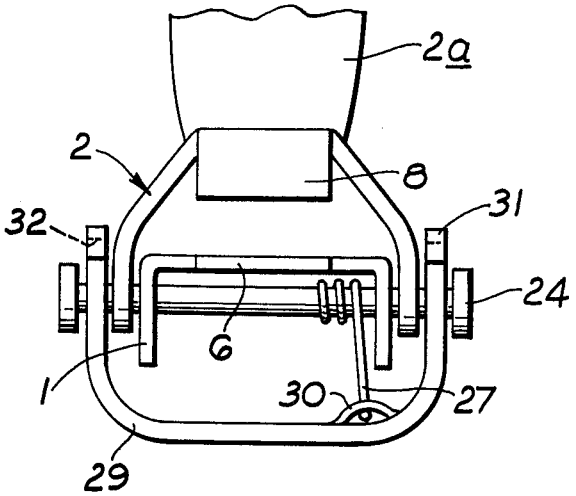
FIG. 8 is an end elevation from the right of the tool of FIG. 7.

Referring now to the embodiment of FIGS. 7 and 8, a tool similar to the embodiment of FIG. 6 is illustrated, and the same reference numerals have been used for similar parts.

In this embodiment the handle 2*a* has its lower end forked to form a pair of legs 28 located on each side of the handle 1 and operable to pivot a lever arm 29 in a clock-wise direction when viewed as in FIG. 7 relative to the first member 1 when the tool is gripped and moved to closed position. The arm 29 is biased to the position as shown in FIG. 7 by a torsion spring 27 which is partially shown in FIG. 8. One end of the spring engages in an interior lug 30 on the inside of the lever arm 29, the body of the spring extends around the secondary pivot shaft 24 and the rear of the spring which cannot be seen in the drawing extends through an apperture in the top of the handle 1 to lie in abuttment with the interior of the handle 2 in the region of its abuttment with the lug 26. Thus this spring urges the handles and the lever arm 29 into the position shown in FIG. 7.

As best seen from FIG. 8 of the lever arm 29 is U-shaped in end view with arms 31 projecting forwardly and having respective notches 32 for engaging on the edge of the rim of a tin.

FIG. 8 also shows that the handles 1 and 2 are both generally U-shaped.

When the tool is to be used, the nose 6 is inserted under the peripheral lip of the tin lid and this results in the notch 32 in each arm 31 being positioned over the edge of the rim of the tin. When the handles are squeezed together, the lugs 28 of the handle 2*a* engage under corresponding inwardly turned lugs 33 at the rear of the lever arm 29 to rotate the lever arm clock-wise relative to the handle 1 thereby bringing the notches 32 into engagement with the rim; simultaneously the lug 25 engages under the rear tab 26 to rotate the head portion 2*b* clock-wise and continued motion causes engagement of the jaws of the tool over the tin lid with the nose 6 being lifted upwardly relatively to the arms 31 so that the tin lid is forced upwardly without the user exerting any leverage. A helical compression spring 35 fixed to the handle 1 acts to return the handle 2 towards its position shown in FIG. 7 upon release.

I claim:

1. A gripping tool for removing from a tin a lid having an annular peripheral lip projecting from an upstanding flange, the gripping tool comprising first and second members said first and second members being pivotally inter-connected and having an axis of pivoting off-set from the median longitudinal line of the first member, the axis of pivoting off-set to the upper side of said median longitudinal line and having respective jaw elements at one end and characterized by the first member having its jaw element shaped and dimensioned for insertion under the lip of the lid and tapering to a flat tip of screwdriver-like form; and the second member having its jaw element comprising a first part and a second terminal part, the first part being shaped and dimensioned for extending over and in contact with the lip of the lid and the second terminal part being formed and dimensioned to extend down along and in contact with the flange of the lid and beyond the extreme end of said screwdriver tip for gripping the lid when the tool is closed, whereby the flange and lip are supported and prevented from becoming distorted by upward pressure exerted on the lip by means of the flat tip of the jaw element of the first member when the tool is being used to remove said lid from the tin.

2. A gripping tool for removing from a tin a lid having an annular peripheral lip projecting from an upstanding flange, the gripping tool comprising first and second members relatively displaceably interconnected and having respective jaw elements at one end and characterized by the first member having its jaw element shaped and dimensioned for insertion under the lip of the lid and tapering to a flat tip of screwdriver-like form; and the second member comprising separate handle and head portions pivotally mounted on the first member about respective pivot axis, the handle portion having a forwardly projecting end engaging under a rearwardly projecting tail of the head portion, and spring means being provided to bias the head and handle portions to an open position, said second member having its jaw element comprising a first part and a second terminal part, the first part being shaped and dimensioned for extending over and in contact with the lip of the lid and the second terminal part being formed and dimensioned to extend down along and in contact with the flange of the lid and beyond the extreme end of said screwdriver tip for gripping the lid when the tool is closed, whereby the flange and lip are supported and prevented from becoming distorted by upward pressure exerted on the lip by means of the flat tip of the jaw element of the first member when the tool is being used to remove said lid from the tin.

3. A gripping tool according to claim 2 and further characterised by a lever arm pivotally mounted on a forward portion of the first member, the handle portion having forwardly projecting arm means engaging under corresponding lug means on the lever arm and the lever arm having forwardly projecting lugs adapted to engage on the rim of a tin as an abutment away from which the jaw elements are displaced on operation of the tool to lift a tin lid upwardly relative to the tin.

4. A gripping tool for removing from a tin a lid having an annular peripheral lip projecting from an upstanding flange, the gripping tool comprising first and second members relatively displaceably interconnected and having respective jaw elements at one end and characterized by the first member having its jaw element shaped and dimensioned for insertion under the lip of the lid and the second member having its jaw element comprising a first part and a second terminal part, the first part being shaped and dimensioned for extending over the lip of the lid and the second terminal part being formed and dimensioned to extend down over the flange of the lid for gripping the lid when the tool is closed;

wherein the second member comprises separate handle and head portions pivotally mounted on the first member about respective pivot axes, the handle portion having a forwardly projecting end engaging under a rearwardly projecting tail of the head portion, and spring means being provided to bias the head and handle to an open position; and a lever arm pivotally mounted on a forward position of the first member, the handle portion having a forwardly projecting arm means engaging under corresponding lug means on the lever arm and the lever arm having forwardly projecting lugs adapted to engage on the rim of a tin as an abutment away from which the jaw elements are displaced on operation of the tool to lift a tin lid upwardly relative to the tin.

5. A gripping tool for removing from a tin a lid having an annular peripheral lip projecting from an upstanding flange, the gripping tool comprising first and second members relatively displaceably inter-connected and having respective jaw elements at one end and characterized by the first member having its jaw element shaped and dimensioned for insertion under the lip of the lid and the second member having its jaw element comprising a first part and a second terminal part, the first part being shaped and dimensioned for extending over the lip of the lid and the second terminal part being formed and dimensioned to extend down over the flange of the lid for gripping the lid when the tool is closed; and, a lever arm pivotally mounted on a forward portion of one of the first and second members and having at least one forwardly projecting lug adapted to engage on the rim of a tin, and at least one rearwardly projecting lug, and means attached to one of the first and second members for engaging the at least one rearwardly projecting lug and thereby pivoting the lever arm sufficiently for the at least one forwardly projecting lug to engage the rim of a tin as an abutment away from which the jaw elements are displaced on operation of the tool to lift a tin lid upwardly relative to the tin.

* * * * *